US005168913A

United States Patent [19]

Haines

[11] Patent Number: 5,168,913

[45] Date of Patent: Dec. 8, 1992

[54] VERTICAL BLIND ASSEMBLY

[75] Inventor: Richard K. Haines, Elkhart, Ind.

[73] Assignee: Elkhart Door, Inc., Elkhart, Ind.

[21] Appl. No.: 675,185

[22] Filed: Mar. 26, 1991

[51] Int. Cl.[5] ..... E06B 9/30

[52] U.S. Cl. ..... 160/168.1; 160/176.1; 160/900

[58] Field of Search ..... 160/168.1, 176.1, 172, 160/177, 173, 178.1, 236, 900

[56] References Cited

U.S. PATENT DOCUMENTS

| | | | |
|---|---|---|---|
| 2,188,575 | 1/1940 | McLennan | 160/172 X |
| 2,503,441 | 4/1950 | Kamm | 160/172 |
| 2,604,159 | 7/1952 | Wright | 160/172 |
| 2,827,956 | 3/1958 | Achler et al. | 160/172 |
| 3,079,988 | 3/1963 | Green | 160/168.1 |
| 3,125,154 | 3/1964 | Woodle | 160/178.1 |
| 3,137,043 | 6/1964 | Moeller | 160/178.1 X |
| 4,006,769 | 2/1977 | Woodle | 160/176.1 |
| 4,114,673 | 9/1978 | de Wit et al. | 160/168.1 |
| 4,214,622 | 7/1980 | Debs | 160/168.1 |
| 4,291,738 | 9/1981 | Grenga et al. | 160/176.1 |
| 4,407,350 | 10/1983 | Nakamura | 160/178.1 |
| 4,696,336 | 9/1987 | Dixon | 160/178.1 |

OTHER PUBLICATIONS

Take Control Single-Handedly—Solitaire Vertical Control System, Graber, a division of Springs Industries (4 pages).

Frei Tric Vertical blind system by Creation Baumann, Carnegie/Creation Baumann (8 pages).

*Primary Examiner*—David M. Purol

*Attorney, Agent, or Firm*—Trexler, Bushnell, Giangiorgi & Blackstone, Ltd.

[57] ABSTRACT

A vertical blind apparatus comprises a top track, a plurality of elongate vanes, and a carrier vane for independently, rotatably and slidably suspending each of the elongate vanes from the top track in side-by-side condition, such that the vanes may be rotated about a given arc relative to the track and also slidably drawn together or apart for opening and closing the blind, and for extending and retracting the blind relative to a window. Each vane carrier includes a resilient vane-receiving clip-like portion for releasably, grippingly engaging a top end portion of a corresponding vane and a glide for suspending the carriers from the track. Each of the vane carriers has oppositely outwardly extending lever arm portions aligned generally in parallel with the plane of the associated vane and generally in parallel with the plane of the associated vane and generally to either side of a vertical central axis thereof. A pair of elongate cords are operatively coupled to the lever arm portions for pivoting and sliding the vanes in unison.

27 Claims, 5 Drawing Sheets

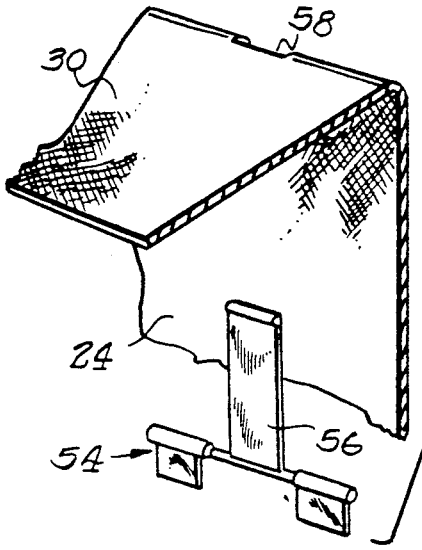
FIG.2
FIG.3
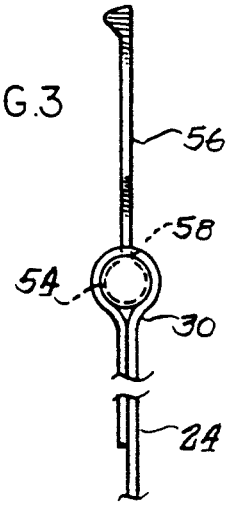
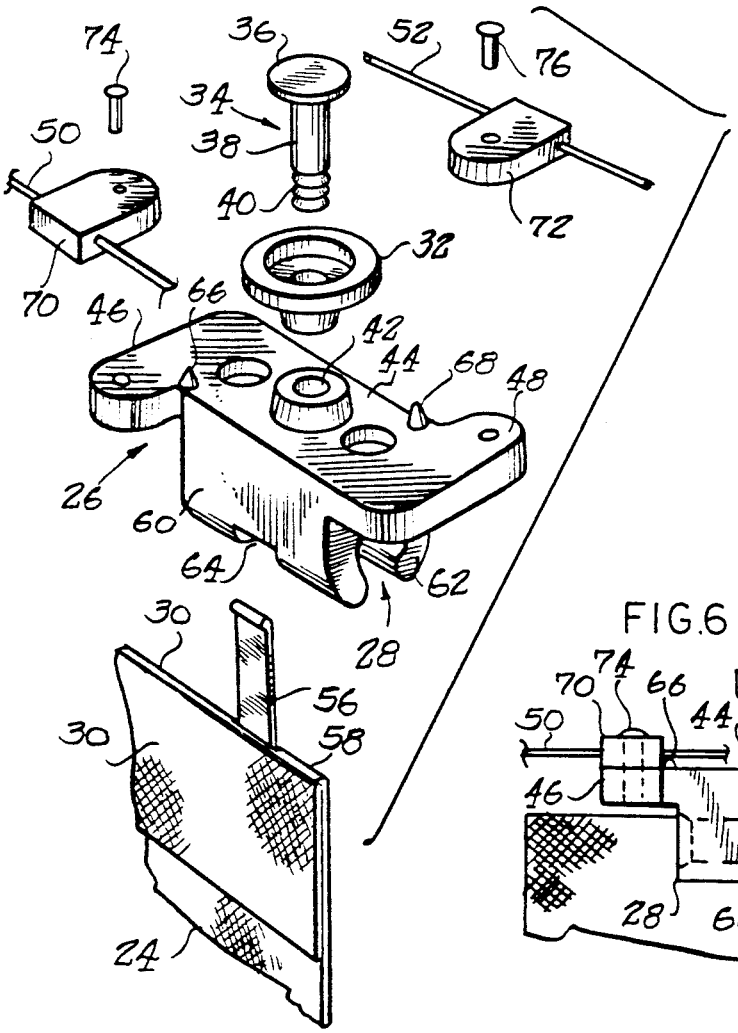
FIG.4
FIG.5
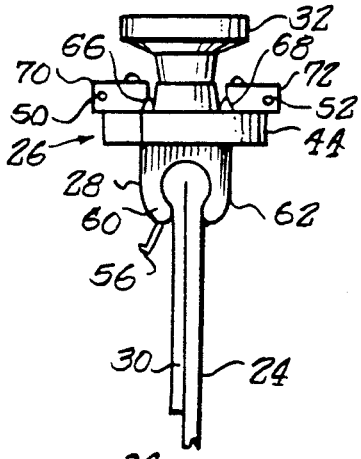
FIG.6
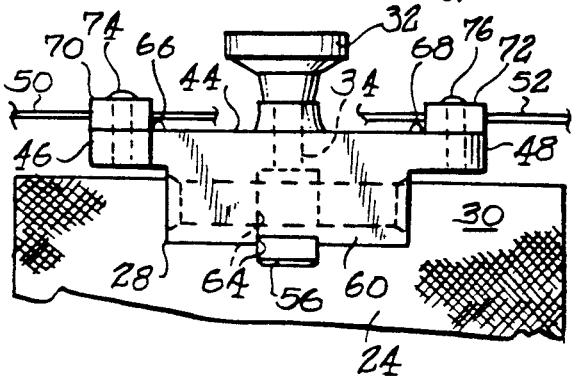

VERTICAL BLIND ASSEMBLY

BACKGROUND OF THE INVENTION

This invention is directed generally to the window treatment arts, and more particularly to a novel and improved vertical blind assembly.

Presently available vertical blind assemblies, for the most part, generally consist of a track and a number of vertically oriented vanes rotatably and slidably suspended from the track. Most existing vertical blind assemblies require two separate controls, one for tilting the vanes and a second control for sliding the vanes for extending and retracting the blind relative to the window. Most of these controls comprise one endless or generally circular cord which traverses suitable sheaves or the like for accomplishing extending and retracting, and a second cord, often in the form of a metal bead chain, which is also circular or endless and drives a suitable pulley or sheave assembly for achieving tilting.

In one more recent type of assembly, the tilting is accomplished by an elongate control handle which is mounted closely adjacent the cord for extending and retracting the blind, or even takes the form of a hollow tube through which the second control cord extends, to simplify the control arrangement somewhat. Generally speaking, presently available vertical blinds all have relatively large track arrangements which house the tilting hardware and spacing systems for maintaining the desired spacing between vanes when the blind is in its extended condition relative to a window. This relatively large track may be unattractive from an aesthetic standpoint in some home installations. Moreover, in the recreational vehicle (RV) market, space is often at a premium such that the relatively large track housing the control assemblies of typical prior art devices may not be readily adapted to RV use.

As a further matter, many prior art vertical blinds leave the bottom end of the vanes free-hanging, or provide a further relatively bulky track and further complex assembly for receiving and guiding the bottom ends of the vanes. Such a further bottom track assembly may suffer from the same aesthetic and space problems as are present in both home and RV use with the relatively large upper track as mentioned above. However, in RV applications, it is generally desirable to control the lower ends of the vanes, as the same preferably should not be left free hanging in a moving vehicle. However, it is desirable to achieve such bottom control in the most economical and simple manner, preferably avoiding expensive and cumbersome bottom tracks and the like. Similarly, freely rotating vanes customary in presently available vertical blinds tend to rotate away from a preselected or desired angular position in a moving RV.

It is also desirable to provide vanes which may be readily removed from the track for cleaning, repair or replacement as necessary, and yet which have a relatively smooth and attractive appearance. Some prior art designs utilize various arrangements of through apertures through the vanes and cumbersome hooks, clips and the like, which generally interrupt and interfere with a smooth and clean appearance of the vanes. Often the vanes are of an attractive fabric material for aesthetic purposes, such that the intrusion of various holes, hooks, clips and other hardware detracts from the overall appearance of the blind when assembled and installed in a window. As a related matter, it is generally desirable to provide assembly and disassembly of the vanes without requiring cumbersome procedures, tools or the like, so that the average consumer can readily remove and reinstall vanes for repair, replacement or cleaning.

In connection with control of tilting and sliding of the vanes relative to the track, it is also desirable to prevent turning of the vanes through more than 180° over center in either direction. Because the vanes preferably overlap somewhat when in the fully closed position, it is desirable to prevent over-rotation, which would cause the overlapping edges to collide and possibly damage the vanes, and also possibly result in misalignment thereof, which would be difficult to correct.

As a further related matter, currently available systems are not readily adaptable for assembly in different configurations for drawing from either the right hand or left hand side of the window or for a center close. Rather, it is usually necessary to manufacture and assemble currently available blinds for only one of these configurations, and the same cannot be easily modified or retrofitted in the field for a different application.

OBJECTS AND SUMMARY OF THE INVENTION

It is a general object of this invention to provide a novel and improved vertical blind assembly.

A related object is to provide a vertical blind assembly which generally avoids the above-mentioned problems of presently available vertical blinds and offers a number of desirable features not presently available, as generally discussed hereinabove.

Briefly, and in accordance with the foregoing objects, a vertical blind assembly in accordance with one aspect of the invention comprises a top track, a plurality of elongate vanes, vane carrier means for independently, rotatably and slidably suspending each of said elongate vanes from said top track in side-by-side condition, such that said vanes may be rotated about a predetermined arc relative to said track and also slidably drawn together or apart for opening and closing of said blind and for extending and retracting said blind relative to a window; each of said vane carrier means including a resilient vane-receiving clip-like portion for releasably, grippingly engaging a top end portion of a corresponding vane and glide means for suspending said carrier means from said track.

In accordance with another aspect of the invention, there is provided control apparatus for a vertical blind assembly for controlling both tilting and sliding motion of a plurality of vertically suspended vanes relative to a track from which the same are suspended, said control apparatus comprising lead main carrier means for rotatably and slidably suspending a leading one of said vanes from said track; vane carrier means for rotatably and slidably suspending each of a plurality of further vanes from said track at locations following said lead vane; each of said lead main carrier means and said vane carrier means having oppositely outwardly extending lever arm portions generally to either side of a vertical central axis of the associated vane; a pair of elongate cord means, and coupling means for coupling each of said elongate cord means to a one of the lever arm portions of each of said carriers for pivoting and sliding said plurality of vanes in unison with said lead vane.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

FIG. 2 is an exploded partial perspective view of a top end portion of a vane assembly of the vertical blind assembly of FIG. 1;

FIG. 3 is an assembled partial side view of the partial vane assembly of FIG. 2;

FIG. 4 is an exploded partial perspective view of a vane suspension assembly for suspending a top end of the vane illustrated in FIGS. 2 and 3 from an overhead track;

FIG. 5 is an assembled partial end view of the assembly of FIG. 4;

FIG. 6 is an assembled partial plan view of the assembly of FIG. 4;

DETAILED DESCRIPTION OF THE ILLUSTRATED EMBODIMENT

Figure 1:
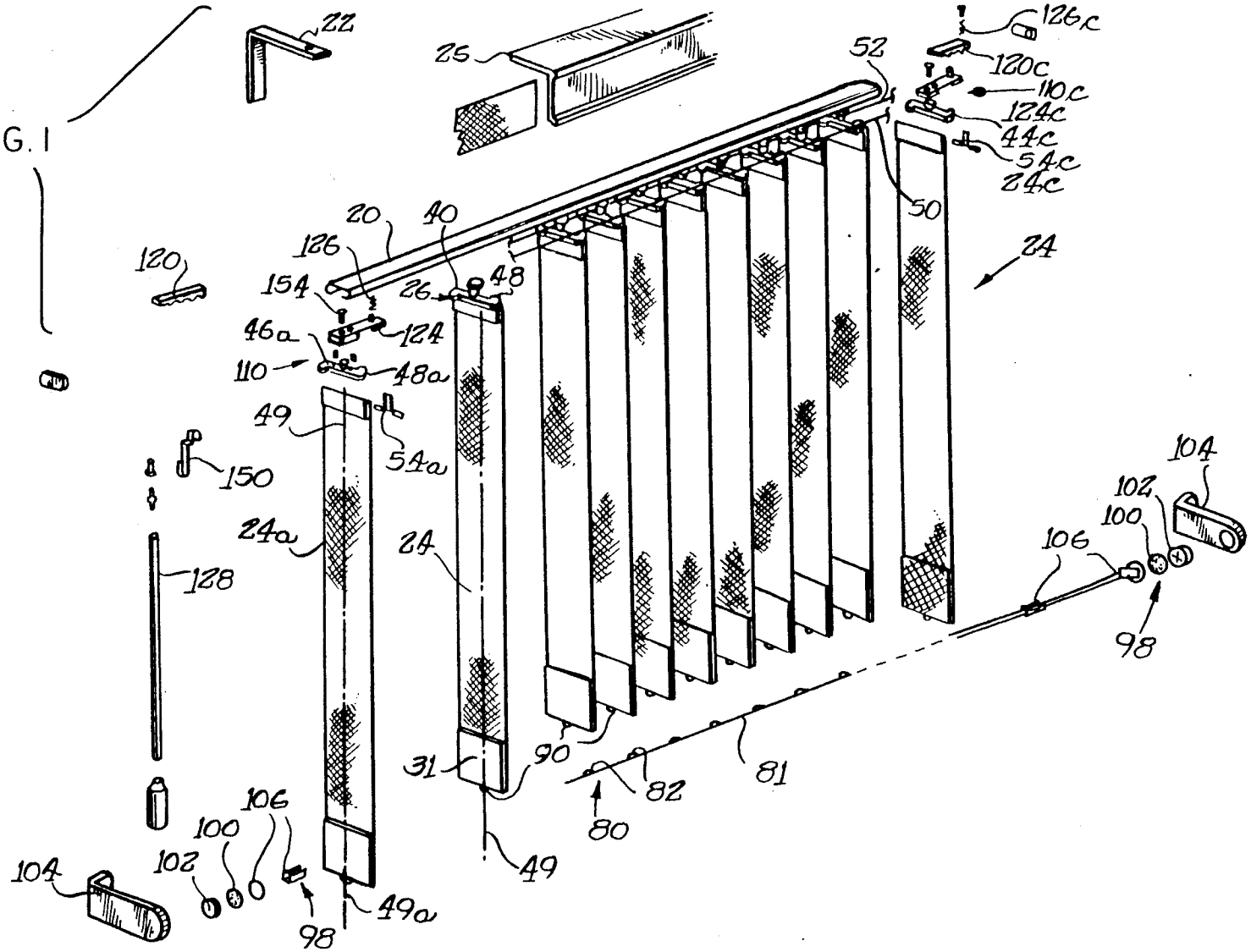
FIG. 1 is a partially exploded perspective view of a vertical blind assembly in accordance with the invention.

Referring now to the drawings and initially to FIG. 1, a vertical blind assembly in accordance with the invention is illustrated in a partially exploded perspective view. Generally speaking, the vertical blind assembly of the invention comprises a top track 20 which may be mounted relative to a window or the like by means of one or more brackets 22. A plurality of elongate vanes designated generally by reference numeral 24 are suspended from the track 20. An additional decorative trim bracket 25 may also be provided to overlie the top front portion of the vanes as well as the track 20 for aesthetic purposes.

Each of the vanes 24 is rotatably and slidably suspended from the track 20 by a vane carrier means or assembly generally designated by reference numeral 26. The carrier means or assemblies 26 suspend the elongate vanes in a side-by-side condition such that the vanes may be rotated about relative to the track 20 for opening or closing the blind relative to a window or the like. The suspension of the vanes 24 from track 20 by carrier means 26 is further such that the vanes may be extended and retracted relative to a window, in addition to the above-described rotation thereof.

Referring briefly to FIGS. 4 and 5, each of the carrier means 26 includes a resilient, vane-receiving clip-like portion 28 for releasably, grippingly engaging a top end portion 30 of an associated vane 24, and glide means 32 for suspending the carrier means 26 from the track 20. In the illustrated embodiment, it will be noted that the glide means 32 comprises a wheel-like member which is rotatably mounted to the carrier assembly by means of a fastener 34 such as a mil-tite fettered drive pin. This fastener comprises a generally rivet-like fastener having an enlarged head portion 36 and an elongate shaft 38 which terminates in a plurality of serrations 40 for engaging a complementary bore or aperture 42 formed in a body portion 44 of the carrier means in a friction fit.

Referring again to FIG. 1, in accordance with the invention, control apparatus is also provided for controlling both the pivoting or tilting motion of the vanes for opening and closing relative to a window and the sliding motion for extension and retraction of the vanes 24 relative to a window. In the illustrated embodiment, the vane carrier assemblies or means 26 have generally oppositely outwardly extending ends, or lever arm portions 46, 48, which extend generally to either side of a vertical central axis 49 of the associated vane. A pair of elongate cords or cord-like members 50, 52 are provided, each being coupled with one of the oppositely outwardly extending ends of each of the vanes 24. It will be seen that when the vanes are in an extended position as generally illustrated in FIG. 1 with respect to those vanes shown suspended from track 20, that the tilting or pivoting motion of any one of the vanes will cause a corresponding tilting or pivoting of all of the vanes. Moreover, any suitable means may be utilized for manipulating the cords 50 and 52 so as to achieve pivoting motion of the vanes 24 in unison when in the extended position.

Additionally, it will be noted that the vanes will slide in unison between positions for fully retracting and fully extending the vanes relative to a window or the like in response to either movement of an endmost or leading one of the vanes 24, or by any other force applied to the cords 50 and 52 to draw the vanes across, or to one side of, the window or other opening. The flexible nature of cords 50 and 52 readily permit the same to collapse or assume a slack position to permit retracting of the vanes 24 in response to a retracting force being applied to an endmost or leading one of the vanes 24. In the illustrated embodiment, vane 24*a* has been illustrated as the lead vane. However, as will be appreciated from the ensuing description, either the left-most or right-most vane as shown in FIG. 1 may be designated as the lead vane. Moreover, it is within the scope of the invention to provide for center control and splitting of the vanes such that two centrally located vanes may both be designated as lead vanes for purposes of both tilting and extending and retracting the vanes relative to a window or the like. It will be appreciated that when in a fully retracted condition, the vanes may be relatively closely engaged in face-to-face condition toward one or both extreme right hand or left hand sides of the track 20.

Referring now to FIGS. 2–6, and initially to FIG. 2, the vane assembly includes a releasably locking hanger member 54 which is affixed to the upper end part 30 of the vane 24. More particularly, the upper end 30 of the vane 24 is folded over to form a compartment or pocket for receiving the hanger member 54 therewithin. The hangar member has a projecting release tab portion 56 which is arranged to project outwardly of the vane 24 through a suitable aperture or opening 58 provided therefor when the upper portion 30 has been folded over as illustrated in FIG. 2. This resulting projection of the hanger member release tab 56 is best viewed in FIGS. 3 and 4.

In operation, the clip-like portion 28 of the carrier 26 includes a pair of elongate, resilient, opposing gripping arms 60, 62 for grippingly engaging the end portion 30 of the vane and the hanger member 54 therebetween. At least one of the arms 60 and 62, and in the illustrated embodiment arm 62, further includes a centrally located groove or slot 64 extending generally vertically along and outwardly of the arm 62 for receiving the release tab 56. Normally the vane 24 with the hanger 54 assembled therewith is assembled with the gripping arms 60, 62 by bending the tab 56 flat or flush against the surface of the vane 24. Thereupon the vane is slid endwise between the gripping arms. When tab 56 reaches the slot 64 it tends to resiliently engage the slot. This both centers and releasably locks the vane in position relative to the carrier 26. Thereafter the vane may be removed from the carrier 26 by again depressing the release tab 56 to release its engagement with slot 64, which permits slidable removal of the vane from the gripping arms 60 and 62. This form of assembly advantageously permits relatively simple removal and replacement of vanes for purposes of cleaning, repair or replacement.

In accordance with a further feature of the preferred form of the invention illustrated herein, stop means are provided for limiting the degree of rotation of the vanes. In the embodiment illustrated in FIGS. 4–6, the stop means take the form of a pair of projections or abutment members 66, 68 on the body 44 located toward the lever arm portion or ends thereof which receive the cords 50 and 52. The cords are pivotally mounted at these ends or lever arms 46, 48 by means of a pair of tabs or tab-like members 70, 72, which are pivotally mounted to the lever arms or ends 46, 48 by suitable means such as rivets 74, 76. The tab members 70 and 72 may be coupled to the cords in any suitable manner. In the illustrated embodiment, these members 70 and 72 are molded of plastics material, and preferably are molded in place at discrete intervals along the respective cords 50 and 52. The spacing of the tabs 70 and 72 along respective cords 50, 52 coincides with the desired spacing between vanes 24 of the assembled blind when the same is fully extended across a window or the like.

In operation, it will be appreciated that the projecting stops or abutment surfaces 66 and 68 will abut the respective tabs 70 and 72 as they pivot or rotate relative to the ends or lever arms 46, 48. This limits rotation of the body 44 and hence of the attached vane 24 to approximately 90° in either direction from a centered position in which the vanes 24 are substantially at right angles to the axis of track 20 as illustrated, for example, in FIG. 1. This limitation prevents over-rotation and possible damage to the vanes which are arranged such that with the customary spacing, when the same are rotated to a closed position, generally in parallel with the track, each vane will overlap the next adjacent vane slightly. Hence over-rotation beyond this overlapping abutting condition when in a fully closed position is to be avoided. The arrangement of the stops 66, 68 is such that together they limit rotation of the vanes to substantially a 180° arc between respective positions wherein the vanes are substantially in parallel with the track 20 with opposite faces thereof exposed when viewed from a given side of the window or the like.

Figure 7:
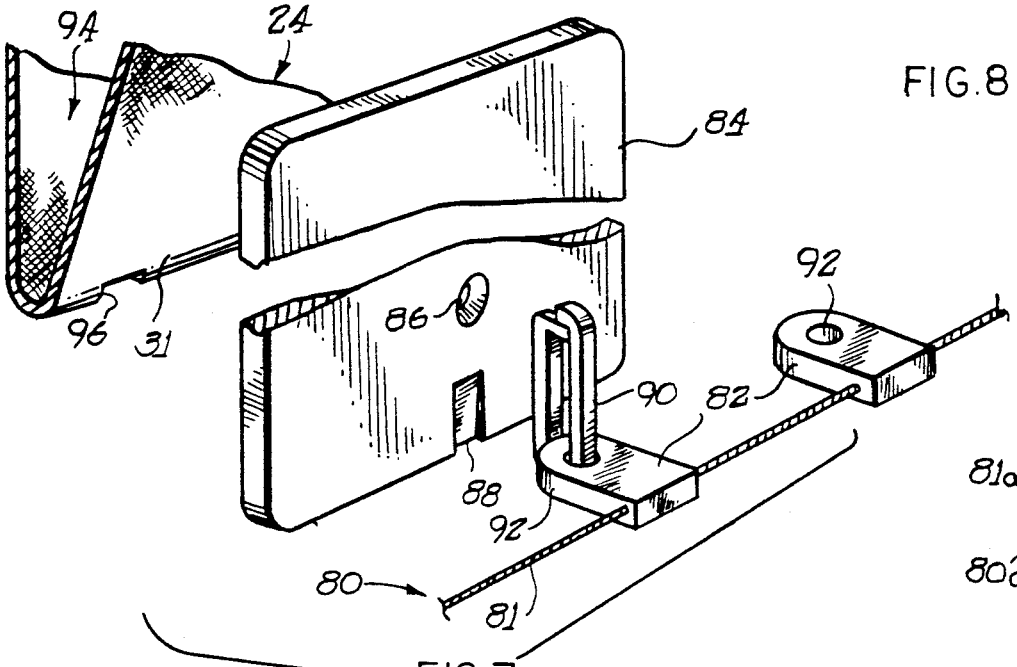
FIG. 7 is an exploded partial perspective view of a vane bottom portion assembly of the vertical blind assembly of the invention.

Reference is next invited to FIG. 7, wherein a novel arrangement for securing the bottom ends of respective vanes 24 is illustrated. Advantageously, the present invention provides means for joining the bottom ends of the blinds and maintaining the desired spacing therebetween, and also for substantially anchoring these bottom ends of the blinds to prevent the same from being free-hanging as is often the case with existing vertical blind assemblies. It will be appreciated that free-hanging blinds may be inappropriate for use in recreational vehicles or the like.

Accordingly, and referring now more particularly to FIG. 7, apparatus for joining the bottom ends of the vanes includes an elongate cord or cord means or assembly 80. In the illustrated embodiment this cord means 80 is substantially similar to the cords 50, 52 previously described in that it comprises a cord 81 which mounts a plurality of spaced tab members 82 which are substantially similar to the tabs 70 and 72 previously described with reference to FIG. 4. These tabs 82 are similarly spaced along the cord 81 to correspond to the desired spacing of the vanes when the same are in the extended condition as illustrated, for example, in FIG. 1. The cord means or assembly 80 joins a central part of a bottom edge 31 of each of the vanes 24 so as to permit free pivoting or rotation thereof relative to the track 20 and about the central axis 49 of each vane 24.

Figure 8:
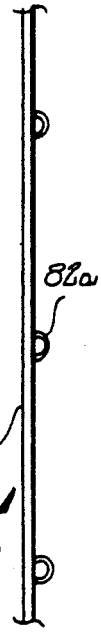
FIG. 8 is a partial elevation of an alternative form of cord for use with the vane assembly of the invention.

The preferred embodiment, illustrated in FIG. 7, also utilizes a weight member 84 having a through opening 86 therein. The weight 84 also has a groove or slot 88 at a bottom portion thereof. The through opening 86 and slot 88 receive a clip or clip-like member 90 which is also attached to a through opening 92 in the associated tab member 82 of the cord assembly 80. The weight 84 is received in a pocket 94 which is formed by folding over an end part 31 of the vane 24 in similar fashion to the top assembly thereof described hereinabove with reference to FIG. 2. Cooperatively, a through central opening 96 is provided in the vane to receive the clip 90 therethrough. Referring briefly to FIG. 8, an alternate embodiment **80*a* of a cord assembly is illustrated in which a series of loops 82*a* are formed at spaced intervals along the body of a cord 81*a*. These loops 82*a* may be used to receive the clips 90 for joining the bottom ends 31 of the vanes 24**.

Referring again briefly to FIG. 1, the cord means or assembly 80 has opposite free ends which extend oppositely of endmost ones of the vanes 24. Releasable hooking means designated generally by reference numeral 98 are provided for releasably hooking or coupling the opposite free ends of the cord means 80 to stationary surfaces for stabilizing the vanes and for maintaining the desired spacing between vanes at their bottom ends when the blind is in a fully extended condition relative to a window or the like. In the illustrated embodiment, the releasable hooking means 98 includes a mating set of Velcro TM hook and loop members 100, 102, one of which is mounted to the fixed surface such as a bracket 104 and the other of which is mounted to a clip or connector member 106 for receiving an end part of cord means 80. Hence opposite ends of the cord means 80 may be effectively anchored when the blind is in its fully extended condition to permit tilting or rotation thereof, but to substantially prevent free swinging thereof, as may be undesirable when installed in an RV or the like. However, the Velcro loops or other means for hooking or anchoring opposite ends of the cord assembly 80 may be readily released from engagement with their associated stationary support surfaces to permit retraction of the blind relative to a window or the like.

Referring now to FIGS. 9–13, a lead main carrier means or assembly 110 for rotatably and slidably suspending a leading one of the vanes 24*a* from the track 20 is illustrated. The portion of the lead main carrier which attaches to the vane 24*a* is substantially similar to the vane carrier structure 26 as illustrated and described hereinabove with reference to FIGS. 2–6. As such, like reference numerals with the suffix a are utilized in FIGS. 9–13 to designate similar components, and these components will not again be described in detail.

Figure 10:
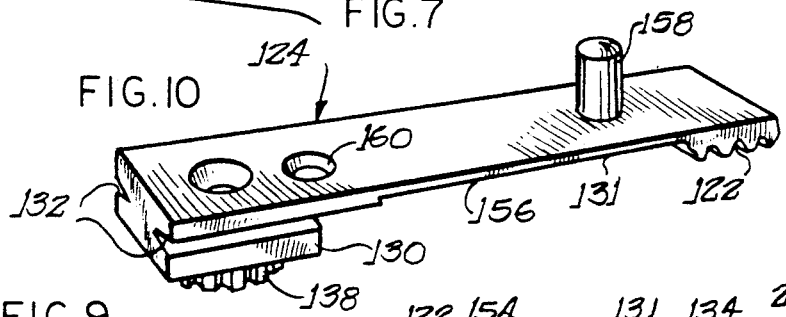
FIG. 10 is a perspective view of one element of the assembly of FIG. 9.

A holding stop member or means 120 which, in the illustrated embodiment, takes the form of an elongate toothed rack member is coupled with the track 20. Cooperatively, a stop means or member 124 which is also shown in unassembled condition in FIG. 10, is coupled with the lead main carrier means or assembly 110. Biasing means, here illustrated as a compression spring 126 are provided for normally biasing the cooperating stop means 124 for engagement with the holding stop means 120. More particularly, it will be seen that stop means 124 includes a base 130 and a resilient cantilevered portion 131 which carries an abbreviated rack-like portion 122 having teeth of complementary configuration for engaging the teeth of the rack member 20. The spring 126 biases the resilient cantilevered portion 131 in a direction for engaging teeth 122 with rack 120. However, other forms of cooperating stop surfaces may be utilized without departing from the invention.

As will be described more fully hereinbelow, a control means or member 128 is operatively coupled with the cooperating stop means 124 for overcoming the biasing means 126 to permit slidable movement of the main carrier assembly 110 relative to the track.

In this regard, the base portion 130 has a pair of grooves 132 at lateral side edges thereof for slidably engaging the track 20. This structure replaces the glide wheel members 32 illustrated and described above with respect to the vane carrier assemblies 26.

In the illustrated embodiment, the holding stop means or rack 120 has a ramp-like lead-in portion 134 at either end thereof to assist in overcoming the biasing force of the spring and bend back the cooperating teeth or rack member 122 of cooperating stop member 124 as the same slidably approaches the rack 120 from either direction. This permits relatively easy re-engagement of the teeth 122 with the rack 120 when the same are disengaged.

The lead main carrier means or assembly 110 also includes detent means 136 for defining a plurality of discrete angular positions of the vane 24 relative to the track 20. It will be appreciated that in consequence of the connection between vanes established by cords 50 and 52, that when the vanes are in the extended position as illustrated in part in FIG. 1, the cords are relatively taut, such that any tilting of the lead vane will result in a corresponding tilting of all of the vanes 24. Conversely, the detenting of any one vane will also effectively detent all of the vanes.

In the illustrated embodiment, the detent means comprises a toothed wheel or ratchet wheel member 138 which is either integrally molded with or otherwise affixed to the body 130. A pair of somewhat resilient pin members 140 (see FIG. 13) are affixed to and project upwardly from the carrier body 44*a* at diametrically opposed locations relative to the ratchet wheel 138. The somewhat resilient pins normally engage the ratchet wheel 138 when in the position illustrated in FIG. 9, to thereby define a ratchet or detent mechanism. It will be appreciated that such control of the angular position of the vanes is particularly desirable in RV installations.

In accordance with a further feature of the invention, the single, common control member 128 is arranged for both tilting the vanes and also for sliding the vanes relative to a window or the like. Moreover, the control member 128 is also operatively coupled for simultaneously disengaging both the ratcheting or detent means or assembly 136 and also the holding means provided by rack 120 and cooperating teeth 122. This disengaged position of both detent means and holding means is illustrated in FIG. 13, to which reference is invited.

In the illustrated embodiment, the control member 128 is coupled by way of a resilient spring-like clip member 150 between the resilient clip-like arms 60*a*, 62*a* of the carrier body 44*a*. It will be noted that the clip member 150 is formed to surroundingly engage the top end portion of the vane 24*a* which has been folded over and provided with a hanger 54 in the same fashion as described hereinabove with reference to the vane 24 illustrated in FIGS. 2–6. The clip 150 conveniently fits intermediate the top end of the vane assembly and the interior surface of the clip-like arms 60*a*, 62*a* within body 44*a*.

Figure 9:
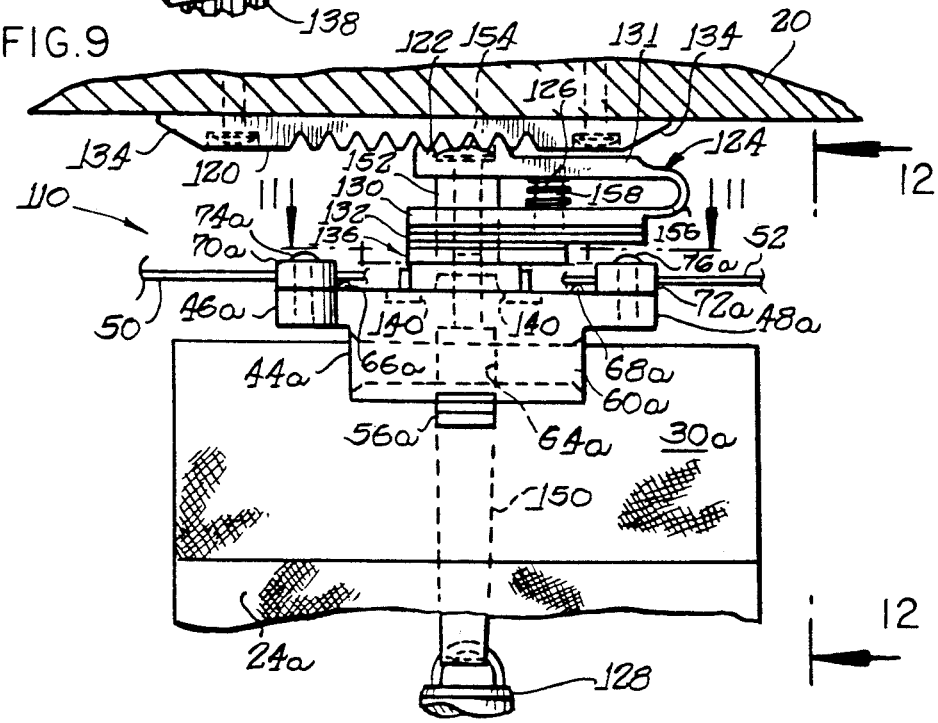
FIG. 9 is a partial side elevational view of a lead vane and its suspension assembly, including a tilting and sliding control arrangement in accordance with the invention.
Figure 11:
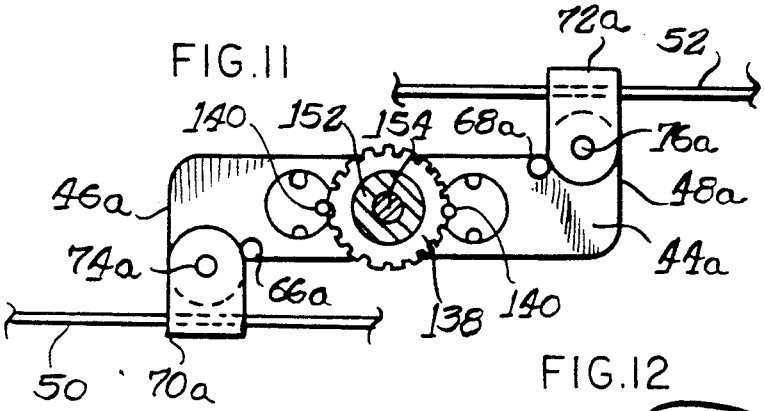
FIG. 11 is a partial sectional view taken generally along the line 11—11 of FIG. 9.
Figure 12:
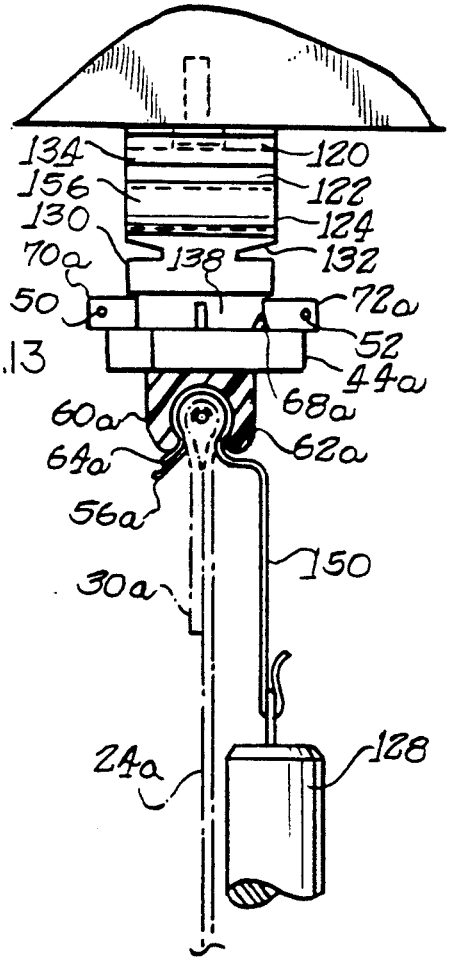
FIG. 12 is a partial end view taken generally along the line 12—12 of FIG. 9.
Figure 13:
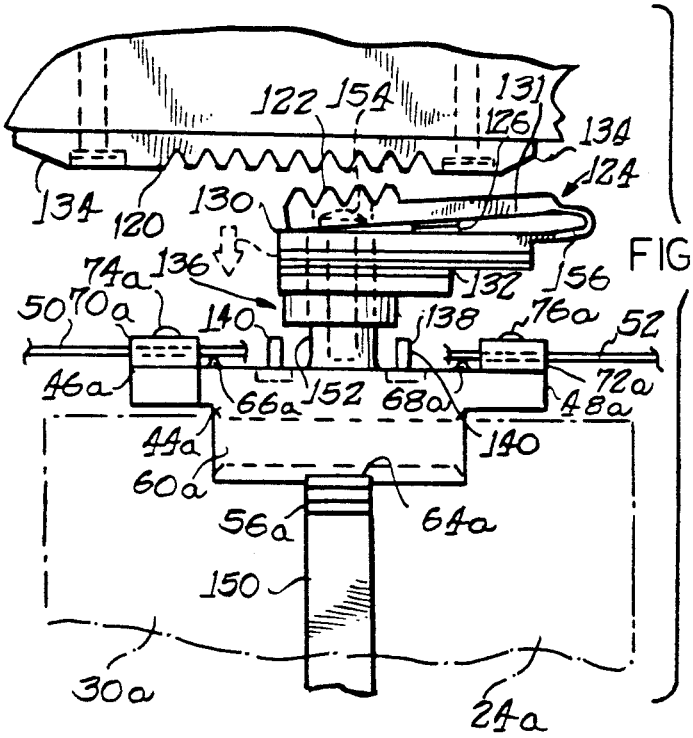
FIG. 13 is an elevational view similar to FIG. 9 illustrating a moved position of the assembly thereof.

As best viewed in FIGS. 9 and 13, the lead main carrier means body 44*a* includes an elongate upwardly projecting shaft 152 which mounts both the body 130 and the wheel 138. The cooperating stop teeth 122 of the stop member 124 are rigidly coupled with a top end of the shaft 152 by means of an elongate rivet-like pin member 154, which preferably comprises a mil-tite type of fastener of the same general type as the fastener 34 described hereinabove.

It will be noted with reference to FIG. 10 that the locking teeth of the member 124 are formed at an end thereof generally opposite the end at which the ratchet wheel 138 is mounted or formed. Intermediate these two sections is formed a living hinge section 156 which permits bending over of the member 124 upon itself to the form for assembly shown in FIGS. 9–13. With further reference to FIG. 10, an additional projecting pin 158 is also provided adjacent stop teeth 122 and when living hinge section 156 is folded over this pin 158 engages a complementary aperture 160 formed in the body 130 for receiving the compression spring 126. The degree of resilient movement permitted by spring 126 permits general downward movement of shaft 152 by control member 128 for compression of the cantilevered portion 131 against body 130. This movement also permits partial withdrawal of shaft 152 relative to ratchet wheel 138, thereby removing the cooperating pins 140 from contact therewith as illustrated in FIG. 13. The downward movement of the arm 124 is sufficient to remove the teeth 122 from engagement with the rack 120. Hence, when in the position illustrated in FIG. 13, the lead vane 24 may be freely rotated and also freely slidably moved relative to the track 120.

In accordance with the preferred embodiment of the invention illustrated in FIG. 1, a similar mounting or carrier arrangement 110*c* is also provided for a trailing end vane 24*c* located at an end of the blind assembly opposite the lead vane 24*a*. The vane carrier assembly 110*c* provided for this trailing or opposite end vane 24*c* is substantially identical to that illustrated in FIGS. 9–13. However, this opposite end assembly is not provided with a control member 128 and clip 150. Nor is this trailing assembly provided with the detenting pins 140, such that the same rotates freely relative to the track 20, with detenting being accomplished by lead main carrier assembly 110. The trailing vane 24*c* may be removed from its locked position relative to its corresponding rack 120*c* by grasping and pulling down on the vane 24*c*. It is contemplated that under normal conditions the vane 24*c* will remain engaged with its rack 120*c*.

Figure 14:
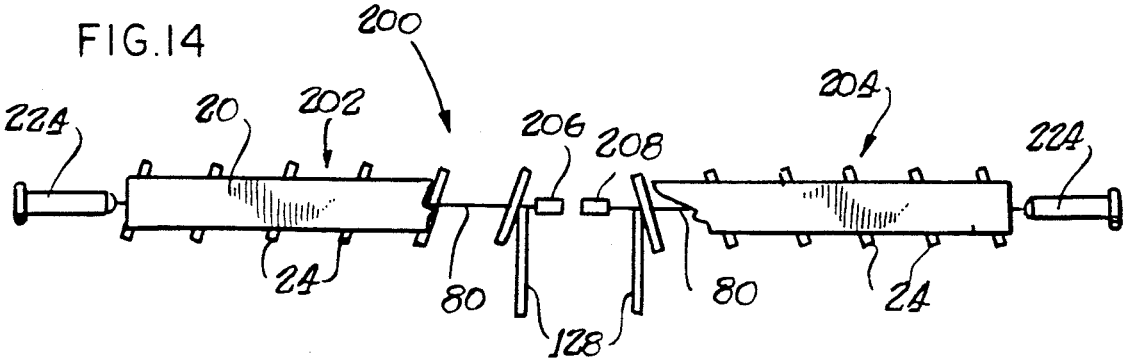
FIG. 14 is a top plan view, somewhat diagrammatic in form, of a center closure arrangement for a vertical blind assembly in accordance with the invention.

Referring now to FIG. 14, in accordance with another aspect of the invention, there is provided a vertical blind assembly designated generally by reference numeral 200. The assembly 200 incorporates a pair of vertical blind assemblies of the same construction as illustrated and described above, which are hung from a track such as track 20, to form a center closure blind arrangement. Like parts and components to those described hereinabove are indicated in FIG. 14 by like reference numerals. The respective blind assemblies are designated in FIG. 14 by reference numerals 202 and 204, it being understood that each of these assemblies is substantially identical to what is shown and described hereinabove with reference to FIG. 1. The assemblies 202 and 204 are mounted to an overhead track 20 such that the respective control members or wands 128 thereof will meet at the center of the assembly 200 when the respective blind assemblies 202, 204 are fully extended. Advantageously, when utilized in an RV application, for example, in a side window, a rear seat passenger may independently tilt the vanes 24 of assembly 204 for either obscuring or exposing the view through an associated window, without disturbing the setting on vanes 24 of assembly 202. This assembly 202 may thereby have its vanes 24 independently set to a desired position by a driver or front seat passenger.

In order to hold the bottom edges of the vanes 24 of respective assemblies 202 and 204 in place when they are in the fully extended position, a suitable additional clip or catch means having cooperating interfitting releasable locking parts 206, 208 is provided at respective facing ends of the respective bottom cords 80 of assemblies 202 and 204.

Figure 15:
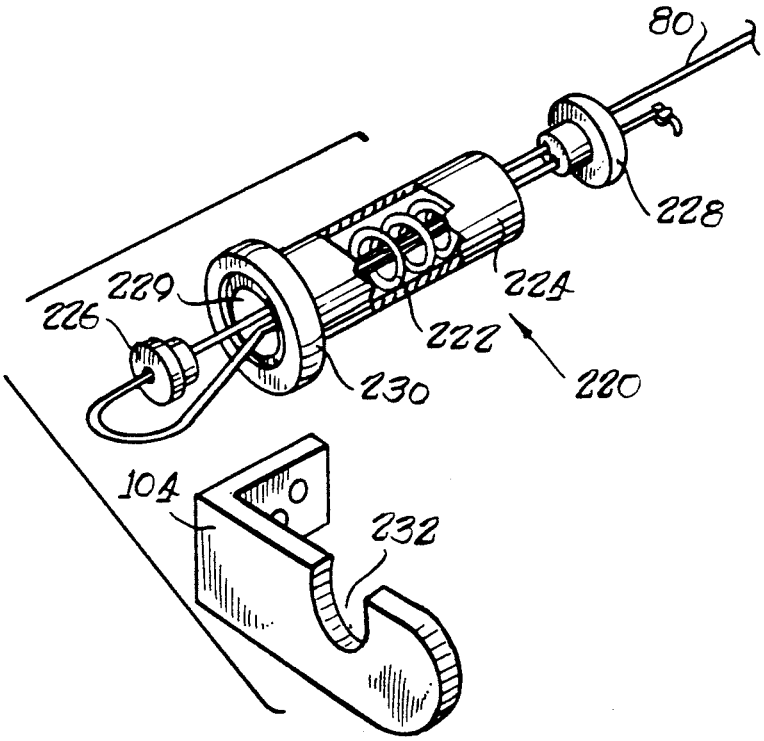
FIGS. 15 and 16 are a perspective view of an alternate form of releasable hooking means for a bottom cord assembly.
Figure 16:
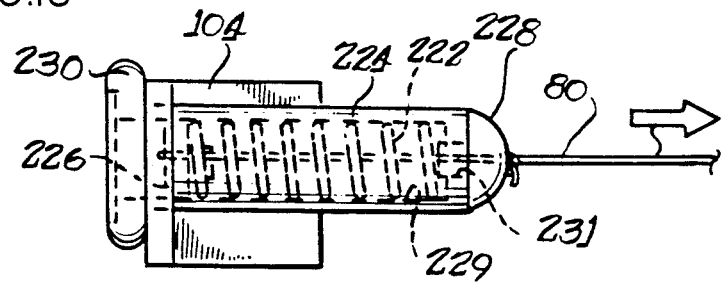

Referring also to FIG. 15, and in accordance with a preferred form of the invention, the releasable hooking means or assembly 98, described above with reference to FIG. 1, is preferably replaced by a spring-loaded assembly 220. Assembly 220 includes a compression-type helical spring 222, a spring housing 224, a button 226 and an end cap 228. Housing 224 has a central through aperture 229 having a reduced diameter entrance aperture 231 and terminates in an enlarged diameter head portion 230. Cooperatively, the bracket 104 is formed with a notch 232 having an open upper end and a complementary shape for receiving the body of housing 224 therein with the enlarged head 230 abutting the bracket about notch 232. The spring 222 is held within the central through aperture or opening 229. The cord 80 is fed through a first aperture in end cap 228, into the central through opening 229, through the center of spring 222 and through button 226 and is then doubled back through the spring 222 and through a second aperture in end cap 228. Hence button 226 abuts against one end of spring 222, the other end of which abuts against the opposite end of the housing 224 about the entrance aperture 231. A similar assembly is provided at each end of cord 80 in the embodiment of FIG. 1. In the embodiment of FIG. 14, the assembly of FIG. 15 is provided at opposite ends of the assembly, that is, at the respective outer end of each of assemblies 202 and 204.

While particular embodiments of the invention are shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention claimed is as follows:

1. A vertical blind apparatus comprising:

a top track;

a plurality of elongate vanes;

vane carrier means for independently, rotatably and slidably suspending each of said elongate vanes from said top track in side-by-side condition, such that said vanes may be rotated about a predetermined arc relative to said track and also slidably drawn together or apart for opening and closing of said blind and for extending and retracting said blind relative to a window;

each of said vane carrier means including a resilient, vane-receiving clip-like portion for releasably, grippingly engaging a top end portion of a corresponding vane said clip-like portion and said vane being configured such that said vane is removable and replaceable without requiring any disassembly of said carrier means, and glide means for suspending said carrier means from said track;

a releasably locking hanger member affixed to an upper end part of each said vane which is held within said clip-like portion of said carrier means for preventing removal of said vane from said clip-like portion, said hanger member having a release tab, a portion of which projects outwardly of said carrier means and is selectively deflectable for permitting removal of said vane from said carrier means.

2. Apparatus according to claim 1 wherein said upper end part of said vane is folded over to define a pocket for receiving said releasably locking hanger member therewithin said pocket having a through opening to receive said release tab projecting therethrough.

3. Apparatus according to claim 1 wherein said clip-like portion of said carrier means includes a pair of resilient opposing gripping arms for grippingly engaging said end portion of said vane and said hanger member therebetween and a slot extending through and outwardly of at least one of said arms for receiving said release tab for both centering and releasably locking said vane relative to said clip-like portion and for allowing an end portion of said release tab to project outwardly thereof for selective release of said vane.

4. Apparatus according to claim 1 and further including lead main carrier means for rotatably and slidably suspending a leading one of said vanes from said track;

said vane carrier means suspending each of a plurality of further vanes from said track at locations following said lead vane;

each of said lead main carrier means and said vane carrier means having oppositely outwardly extending lever arm portions generally to either side of a vertical central axis of the associated vane;

and a pair of elongate cord means, and coupling means for coupling each of said elongate cord means to one of said lever arm portions of each of said carriers for pivoting and sliding said plurality of vanes in unison with said lead vane.

5. Apparatus according to claim 4 and further including holding stop means coupled with said track means and cooperating stop means coupled with said lead main carrier means, biasing means for normally biasing said cooperating stop means into engagement with said holding stop means so as to prevent sliding of said lead main carrier means relative to said track;

and a control member operatively coupled with said cooperating stop means for overcoming said biasing means and permitting slidable movement of said lead main carrier means relative to said track.

6. Apparatus according to claim 5 where one of said holding stop means and said cooperating stop means has a ramp-like lead-in portion for overcoming said biasing force as the other of said holding stop means and said cooperating stop means engage said ramp-like lead-in surface in response to sliding of said lead main carrier means in at least one direction relative to said track to permit engagement of said holding stop means with the cooperating stop means.

7. Apparatus according to claim 4 wherein said lead main carrier means includes detent means for defining a plurality of discrete angular positions of said vanes relative to said track.

8. Apparatus according to claim 5 wherein said lead main carrier means includes detent means for defining a plurality of discrete angular positions of said vanes relative to said track.

9. Apparatus according to claim 4 and further including a common control member for both tilting and sliding said lead vane relative to said track.

10. Apparatus according to claim 8 and further including a common control member operatively coupled for releasing said detent means and for releasing the cooperating stop means from engagement with said holding stop means.

11. Apparatus according to claim 10 wherein said lead main carrier means includes an elongate shaft which mounts said cooperating stop means and wherein said cooperating stop means includes a base portion and a locking portion resiliently cantilevered from said base portion and having a plurality of upwardly projecting teeth, said holding stop means having complementary teeth formed thereon for engagement with said upwardly projecting teeth.

12. Apparatus according to claim 11 wherein said detent means includes a toothed wheel coupled with said base portion of said cooperating stop means and having a through opening through which said lead main carrier means elongate shaft extends, and wherein said lead main carrier means includes at least one projecting detent member for engagement with said toothed wheel to form said detent means; and wherein said control member is arranged for subjecting said lead main carrier means to a force for partially withdrawing said shaft from said toothed wheel to an extent sufficient to disengage said at least one detent member out of engagement therewith, and for simultaneously collapsing said resiliently cantilevered locking portion of said cooperating stop means to withdraw the teeth thereon from engagement with the complementary teeth of said holding stop means.

13. Apparatus according to claim 9 wherein said lead main carrier means includes a clip-like portion for releasably grippingly engaging a top end portion of an associated lead vane and wherein said common control member includes a resilient connector member interposable intermediate said clip-like portion of said lead main carrier means and said top end portion of said associated lead vane, and a control lever extending from said connector member for controlling both tilting and sliding of said lead vane relative to said track.

14. Apparatus according to claim 4 wherein said coupling means further includes a cord-receiving tab pivotally coupled with each said lever arm portion thereof for receiving the respective cord means, and stop means for limiting the degree of rotation of said pivotally mounted tab.

15. Control apparatus for a vertical blind assembly for controlling both tilting and sliding motion of a plurality of vertically suspended vanes relative to a track from which the same are suspended, said control apparatus comprising:

lead main carrier means for rotatably and slidably suspending a leading one of said vanes from said track;

vane carrier means for rotatably and slidably suspending each of a plurality of further vanes from said track at locations following said lead vane;

each of said lead main carrier means and said vane carrier means having oppositely outwardly extending lever arm portions generally to either side of a vertical central axis of the associated vane;

a pair of elongate cord means, and coupling means for coupling each of said elongate cord means to one of said lever arm portions of each of said carriers for pivoting and sliding said plurality of vanes in unison with said lead vane; wherein said lead main carrier means includes detent means for defining a plurality of discrete angular positions of said vanes relative to said track.

16. Apparatus according to claim 15 and further including holding stop means coupled with said track means and cooperating stop means coupled with said lead main carrier means, biasing means for normally biasing said cooperating stop means into engagement with said holding stop means so as to prevent sliding of said lead main carrier means relative to said track;

and a control member operatively coupled with said cooperating stop means for overcoming said biasing means and permitting slidable movement of said lead main carrier means relative to said track.

17. Apparatus according to claim 16 where one of said holding stop means and said cooperating stop means has a ramp-like lead-in portion for overcoming said biasing force as the other of said holding stop means and said cooperating stop means engage said ramp-like lead-in surface in response to sliding said lead main carrier means in at least one direction relative to said track to permit engagement of said holding stop means with the cooperating stop means.

18. Apparatus according to claim 15 and further including a common control member for both tilting and sliding said lead vane relative to said track.

19. Apparatus according to claim 15 and further including a common control member operatively coupled for releasing said detent means and for releasing the cooperating stop means from engagement with said holding stop means.

20. Apparatus according to claim 16 wherein said lead main carrier means includes an elongate shaft which mounts said cooperating stop means and wherein said cooperating stop means includes a base portion and a locking portion resiliently cantilevered from said base portion and having a plurality of upwardly projecting teeth, said holding stop means having complementary teeth formed thereon for engagement with said upwardly projecting teeth.

21. Apparatus according to claim 20 wherein said detent means includes a toothed wheel coupled with said base portion of said cooperating stop means and having a through opening through which said lead main carrier means elongate shaft extends, and wherein said lead main carrier means includes at least one projecting detent member for engagement with said toothed wheel to form said detent means; and wherein said control member is arranged for subjecting said lead main carrier means to a force for partially withdrawing said shaft from said toothed wheel to an extent sufficient to disengage said at least one detent member out of engagement therewith, and for simultaneously collapsing said resiliently cantilevered locking portion of said cooperating stop means to withdraw the teeth thereon from engagement with the complementary teeth of said holding stop means.

22. Apparatus according to claim 18 wherein said lead main carrier means includes a clip-like portion for releasably grippingly engaging a top end portion of an associated lead vane wherein said common control member included a resilient connector member interposable intermediate said clip-like portion of said lead main carrier means and said top end portion of said associated lead vane, and a control lever extending from said connector member for controlling both tilting and sliding of said lead vane relative to said track.

23. Apparatus according to claim 15 wherein each said vane carrier further includes a cord-receiving tab pivotally coupled with each said lever arm portion thereof for receiving the respective cord means, and stop means for limiting the degree of rotation of said pivotally mounted tab.

24. Apparatus for joining bottom ends of a plurality of vanes of a vertical blind assembly comprising an elongate cord for joining a central part of a bottom edge of each of said vanes to permit free pivoting of each said vane relative to a central axis thereof and to cause movement of said bottom portions thereof in response to movement of a leading one of said vanes in at least a direction for achieving an extended condition of the blind relative to a window and to assure desired spacing between vanes when said blind assembly is in said extended condition; and further including a plurality of weights, each having a through opening therein, weight receiving means operatively coupling each of said weights to a bottom portion of one of said vanes and clip means for operatively engaging said cord means and said through opening of each said weight; wherein said weight receiving means comprises a folded over portion of said vane forming a pocket for receiving a weight therewithin and a through opening in said pocket for receiving said clip means therethrough.

25. Apparatus according to claim 24 wherein said cord means has opposite free ends extending oppositely outwardly of endmost ones of said vanes and further including releasably engagement means for releasably coupling said opposite free ends of said cord means to stationary surfaces for stabilizing and maintaining a desired spacing between said vanes at bottom ends thereof when said blind assembly is in a fully extended condition relative to a window.

26. Control apparatus for a vertical blind assembly for controlling both tilting and sliding motion of a plurality of vertically suspended vanes relative to track from which the same are suspended, said control apparatus comprising:

lead main carrier means for rotatably and slidably suspending a leading one of said vanes from said track;

vane carrier means for rotatably and slidably suspending each of a plurality of further vanes from said track at locations following said lead vane;

each of said lead main carrier means and said vane carrier means having oppositely outwardly extending lever arm portions generally to either side of a vertical central axis of the associated vane;

a pair of elongate cord means, and coupling means for coupling each of said elongate cord means to one of said lever arm portions of each of said carriers for pivoting and sliding said plurality of vanes in unison with said lead vane;

wherein said coupling means further includes a cord-receiving tab pivotally coupled with each said lever arm portion thereof for receiving the respective cord means, and stop means for limiting the degree of rotation of said pivotally mounted tab.

27. Control apparatus for a vertical blind assembly for controlling both tilting and sliding motion of a plurality of vertically suspended vanes relative to track from which the same are suspended, said control apparatus comprising:

lead main carrier means for rotatably and slidably suspending a leading one of said vanes from said track;

vane carrier means for rotatably and slidably suspending each of a plurality of further vanes from said track at locations following said lead vane;

each of said lead main carrier means and said vane carrier means having oppositely outwardly extending lever arm portions generally to either side of a vertical central axis of the associated vane;

a pair of elongate cord means, and coupling means for coupling each of said elongate cord means to one of said lever arm portions of each of said carriers for pivoting and sliding said plurality of vanes in unison with said lead vane;

holding stop means coupled with said track means and cooperating stop means coupled with said lead main carrier means, biasing means for normally biasing said cooperating stop means into engagement with said holding stop means so as to prevent sliding of said lead main carrier means relative to said track;

and a control member operatively coupled with said cooperating stop means for overcoming said biasing means and permitting slidably movement of said lead main carrier means relative to said track; wherein said lead main carrier means includes an elongate shaft which mounts said cooperating stop means and wherein said cooperating stop means includes a base portion and a locking portion resiliently cantilevered from said base portion and having a plurality of upwardly projecting teeth, said holding stop means having complementary teeth formed thereon for engagement with said upwardly projecting teeth.

* * * * *